US009556008B2

(12) United States Patent
Ogden

(10) Patent No.: US 9,556,008 B2
(45) Date of Patent: Jan. 31, 2017

(54) WINCH WITH DRUM-ENCASED BRUSHLESS DC MOTOR

(71) Applicant: Everett Ogden, Ponte Vedra Beach, FL (US)

(72) Inventor: Everett Ogden, Ponte Vedra Beach, FL (US)

( * ) Notice: Subject to any disclaimer, the term of this patent is extended or adjusted under 35 U.S.C. 154(b) by 234 days.

(21) Appl. No.: 14/072,233

(22) Filed: Nov. 5, 2013

(65) Prior Publication Data

US 2015/0123057 A1 May 7, 2015

(51) Int. Cl.
*B66D 1/12* (2006.01)

(52) U.S. Cl.
CPC ..... *B66D 1/12* (2013.01)

(58) Field of Classification Search
CPC ..... B66D 1/12; B66D 1/30; B66D 3/20; B66D 3/26
See application file for complete search history.

(56) References Cited

U.S. PATENT DOCUMENTS 3,807,697 A * 4/1974 Cotreau ..... B66D 3/18 242/125.1
4,096,404 A * 6/1978 Sukhanov ..... H02K 7/1025 310/67 R
4,310,146 A * 1/1982 F'Geppert ..... B66D 1/22 254/342
4,533,119 A * 8/1985 Liverance ..... B66D 3/22 200/51.09
4,884,784 A * 12/1989 Nix ..... B66D 1/28 254/345
5,249,777 A * 10/1993 Herving ..... A01K 73/06 254/289
7,185,881 B2 3/2007 Drarvik et al.
2002/0047425 A1* 4/2002 Coupart ..... B66D 1/12 310/156.01
2008/0116432 A1* 5/2008 Folk ..... E21B 19/008 254/362
2010/0127229 A1* 5/2010 Kverneland ..... B66D 1/12 254/356
2011/0101292 A1* 5/2011 Kempf ..... B66D 1/22 254/335
2011/0303886 A1* 12/2011 Cryer ..... B66D 1/22 254/340
2013/0276575 A1* 10/2013 Hoebel ..... B62M 6/55 74/640

FOREIGN PATENT DOCUMENTS

GB 191027299 A * 0/1911 ..... B66D 3/22
GB 2048201 A * 12/1980 ..... B66D 1/12

* cited by examiner

*Primary Examiner* — Emmanuel M Marcelo
(74) *Attorney, Agent, or Firm* — Thomas C. Saitta

(57) ABSTRACT

A winch having a brushless DC motor, the brushless DC motor having a fixed, non-rotating shaft and a rotating housing; and a rotating drum mounted to the rotating housing, wherein the rotating housing is fully encased within the rotating drum.

9 Claims, 1 Drawing Sheet

WINCH WITH DRUM-ENCASED BRUSHLESS DC MOTOR

BACKGROUND OF THE INVENTION

This invention relates generally to the field of motorized winding or reeling drums, usually referred to as winches, and more particularly relates to such winches that utilize DC motors as the power source. Even more particularly the invention relates to such winches wherein the DC motor is a brushless motor.

Powered winches for winding, spooling, retrieving or the like are well known devices, the winches commonly comprising a motor means rotating a shaft on which a drum or spool is mounted. For use where AC electrical power is not available, it is known to provide battery powered DC motors to drive the winch. DC powered motors may be classified as brush or brushless. In a brush motor, a spinning armature, the rotor, is mounted between permanent magnets, the stator. The armature contains an electromagnet which creates a magnetic field when electrical current is provided. The magnetic field attracts and repels the permanent magnets of the stator. In order to keep the rotor spinning, the poles of the electromagnet must be changed. This is accomplished by providing brushes which make contact with two spinning electrodes attached to the armature. Drawbacks to a brush DC motor are that the brushes wear out, sparking and electrical noise can result when the connections are made and broken, the brushes limit the maximum speed of the rotor, positioning the electromagnet in the center of the motor makes it harder to cool, and the number of poles available for the rotor are limited.

Because of these shortcomings, brushless DC motors have been developed that utilize relatively inexpensive computers and power transistors in place of the brush structure. In a brushless motor, the permanent magnets are mounted on the rotor and the electromagnets are positioned on the stator. In an in-runner brushless DC motor, the permanent magnets are mounted on a rotating shaft and the electromagnets are mounted in the housing. In an out-runner brushless DC motor, the permanent magnets are mounted on a rotating can or housing and the electromagnets are mounted on a fixed shaft. The rotor is kept spinning by alternating the polarity of the electromagnets. Advantages of a brushless motor include more precise speed control and more efficiency because of the computer control, there is no sparking and less electrical noise, there are no brushes to wear out, and the design allows for a large number of electromagnets on the stator.

Winches, especially portable winches, are often used in non-ideal conditions where dirt, debris, water or similar contaminants can cause damage to the motor. It is therefore an object of this invention to provide a winch powered by an out-runner brushless DC motor, wherein the motor is fully encased within the winch drum and wherein the shaft is fixed and the drum is mounted to the rotating housing. In this manner appropriate seals and bushings prevent ingress of contaminants into the motor.

SUMMARY OF THE INVENTION

The invention is a motorized winch, the winch comprising a brushless DC motor fully encased within the rotating drum of the winch except for the ends of the shaft or axle. The brushless DC motor is an out-runner, in that the permanent magnets are mounted on a rotating outer casing or housing and the electromagnets are mounted on a fixed, non-rotating shaft or axle. In this manner the shaft is the stator and the housing is the rotor. The rotating winch drum is mounted directly to the housing, the drum comprising end flanges having a central opening through which the shaft extends and is fixed to support mounts. Electrical wiring providing current to the electromagnets passes to an external power source through a bore or slot disposed in the shaft.

In alternative terms, the invention is a winch comprising a brushless, out-runner, DC motor, the brushless DC motor comprising a fixed, non-rotating shaft and a rotating housing; a drum directly mounted to the rotating housing whereby the drum rotates with the rotating housing, the drum comprising an annular wall and disk-shaped end flanges mounted to the annular wall, each of the disk-shaped end flanges extending radially beyond the annular wall and having an axial opening, wherein the annular wall and the disk-shaped end flanges fully encase the rotating housing and wherein the fixed, non-rotating shaft extends through the axial openings; electrical wiring partially disposed within the fixed, non-rotating shaft and extending beyond one of the disk-shaped end flanges; and a base member and support members, wherein the fixed, non-rotating shaft is mounted to the support members, and possibly comprising at least one spacer member positioned between each of the disk-shaped end flanges and the rotating housing.

DETAILED DESCRIPTION OF THE INVENTION

Figure 1:
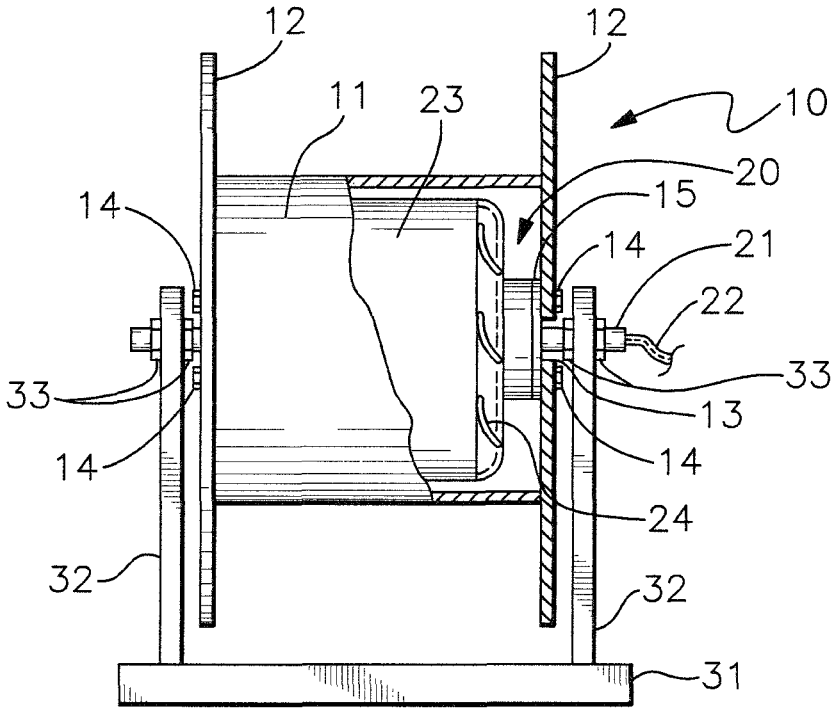
FIG. 1 is a partially exposed view of an embodiment of the invention, showing the brushless DC motor encased within the winch drum.
Figure 2:
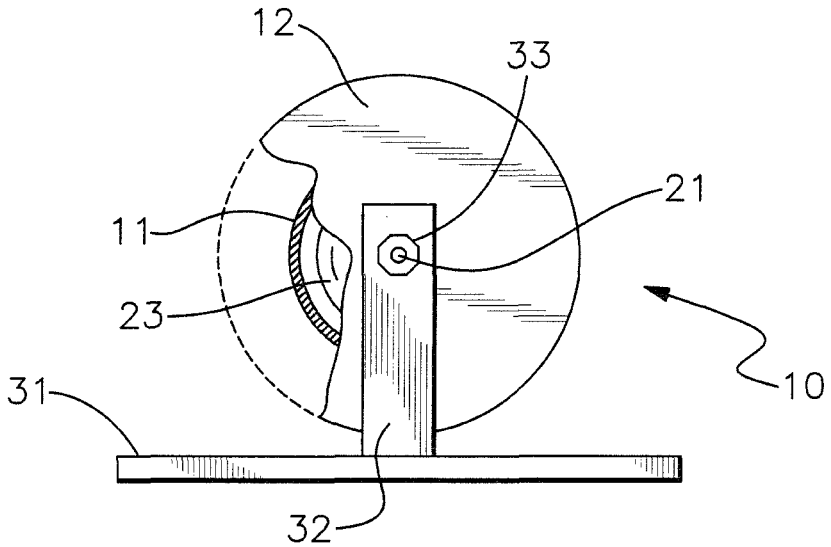
FIG. 2 is a partially exposed axial view of the embodiment of FIG. 1.

With reference to the drawings, one or more embodiments of the invention will now be defined in detail with regard for the best mode and preferred embodiment, the illustrations not intending to be limiting.

In general, the invention is a winch comprising a brushless, out-runner, DC motor 20 controlled by a computer or intelligent chip in known manner, the brushless DC motor 20 comprising a fixed, non-rotating shaft or axle 21 and a rotating housing, casing or can 23 rotatably mounted onto the shaft 21 by bearings or similar structures designed to preclude or greatly minimize ingress of contaminants into the housing 23. In known manner electromagnets are disposed on the shaft 21, the combination partially forming and defining the stator assembly, and in known manner permanent magnets are mounted within the housing 23, the combination partially forming and defining the rotor assembly. The brushless DC motor 20 is powered by an external power source, such as a rechargeable battery, the electrical current being supplied through electrical wiring 22 that is disposed within a bore or slot formed in the shaft 21. With this structure, the housing 23 rotates about the fixed shaft 21 when the motor 20 is operational. In known manner the rotational speed of the motor 20 is easily controlled.

A drum or spool 10 is directly mounted to the rotating housing 23 using for example mechanical mounting fasteners 14, whereby the drum 10 rotates in a one-to-one relationship with the rotating housing 23. The rotating drum 10 comprises an annular wall 11 and two opposing disk-shaped end flanges 12 mounted to each end of the annular wall 11, each disk-shaped end flange 12 extending radially beyond the annular wall 11, i.e., the outer diameters of the end flanges 12 is greater than the outer diameter of the annular wall 11. Each disk-shaped end flange 12 is provided with an axial opening 13 through which shaft 21 extends.

With this structure the drum 10 comprised of the annular wall 11 and the disk-shaped end flanges 12 fully encases the rotating housing 23 with the ends of the fixed, non-rotating shaft 21 extending through the axial openings 13. The electrical wiring 22 required to provide current to the electromagnets of the stator assembly extends outward beyond an end flange 12 through a bore or slot disposed in the fixed shaft 21 for connection to the external power source. A base member 31 with support members 32 is provided, wherein the fixed, non-rotating shaft 21 is mounted to the support members 32 by shaft fasteners 33. In circumstances where a wider drum 10 is required, one or more spacer members 15 are positioned between one or both disk-shaped end flanges 12 and said rotating housing 23. The housing 23 may also be provided with cooling vents 24 to aid in dissipation of the small amount of heat generated within the brushless DC motor 20.

It is contemplated that substitutions or equivalents for elements and structures set forth above my be obvious to those of skill in the art, and therefore the true definition and scope of the invention is to be as set forth in the following claims.

I claim:

1. A winch comprising:

a brushless DC motor, said brushless DC motor comprising a fixed, non-rotating shaft and a rotating housing; and a rotating drum mounted to said rotating housing; wherein said rotating housing is fully encased within said rotating drum;

said rotating drum comprising an annular wall and disk-shaped end flanges mounted to said annular wall, each said disk-shaped end flange extending radially beyond said annular wall and having an axial opening, wherein said annular wall and said disk-shaped end flanges surround said rotating housing and wherein said fixed, non-rotating shaft extends through said axial openings; and further comprising at least one spacer member positioned between each said disk-shaped end flange and said rotating housing.

2. The winch of claim 1, said winch further comprising a base member, wherein said fixed, non-rotating shaft is mounted to said base member.

3. The winch of claim 2, further comprising electrical wiring disposed within said fixed, non-rotating shaft.

4. The winch of claim 1, further comprising electrical wiring disposed within said fixed, non-rotating shaft.

5. The winch of claim 1, further comprising electrical wiring disposed within said fixed, non-rotating shaft and extending beyond one of said disk-shaped end flanges.

6. The winch of claim 1, further comprising cooling vents disposed on said rotating housing.

7. A winch comprising: a brushless DC motor, said brushless DC motor comprising a fixed, non-rotating shaft defining a stator and a rotating housing defining a rotor; a rotating drum mounted to said rotating housing, said rotating drum comprising an annular wall and disk-shaped end flanges mounted to said annular wall, each said disk-shaped end flange extending radially beyond said annular wall and having an axial opening, wherein said annular wall and said disk-shaped end flanges fully encase said rotating housing and wherein said fixed, non-rotating shaft extends through said axial openings; and a base member, wherein said fixed, non-rotating shaft is mounted to said base member: and further comprising at least one spacer member positioned between each said disk-shaped end flange and said rotating housing.

8. The winch of claim 7, further comprising electrical wiring disposed within said fixed, non-rotating shaft and extending beyond one of said disk-shaped end flanges.

9. A winch comprising: a brushless, out-runner, DC motor, said brushless DC motor comprising a fixed, non-rotating shaft and a rotating housing; a drum directly mounted to said rotating housing whereby said drum rotates with said rotating housing, said drum comprising an annular wall and disk-shaped end flanges mounted to said annular wall, each said disk-shaped end flange extending radially beyond said annular wall and having an axial opening, wherein said annular wall and said disk-shaped end flanges fully encase said rotating housing and wherein said fixed, non-rotating shaft extends through said axial openings; electrical wiring disposed within said fixed, non-rotating shaft and extending beyond one of said disk-shaped end flanges; and a base member and support members, wherein said fixed, non-rotating shaft is mounted to said support members; and further comprising at least one spacer member positioned between each said disk-shaped end flange and said rotating housing.

* * * * *